US009718608B2

(12) United States Patent
Tattam et al.

(10) Patent No.: US 9,718,608 B2
(45) Date of Patent: Aug. 1, 2017

(54) TRANSPORT CONTAINER

(75) Inventors: Edwin Francis Tattam, Somerset (GB); Richard William Jones, Berkshire (GB)

(73) Assignee: SOFTBOX SYSTEMS LIMITED, Buckingham (GB)

( * ) Notice: Subject to any disclaimer, the term of this patent is extended or adjusted under 35 U.S.C. 154(b) by 702 days.

(21) Appl. No.: 12/790,329

(22) Filed: May 28, 2010

(65) Prior Publication Data

US 2010/0301057 A1 Dec. 2, 2010

(30) Foreign Application Priority Data

May 29, 2009 (GB) ..... 0909249.5

(51) Int. Cl.
*B65D 81/38* (2006.01)
*B65D 6/24* (2006.01)
(Continued)

(52) U.S. Cl.
CPC ..... *B65D 88/14* (2013.01); *B65D 81/3827* (2013.01); *B65D 81/3834* (2013.01);
(Continued)

(58) Field of Classification Search
CPC .... B65D 81/38; B65D 19/12; B65D 81/3823; B65D 81/3804; B65D 81/3811;
(Continued)

(56) References Cited

U.S. PATENT DOCUMENTS 2,556,418 A 6/1951 Del Mar
3,429,473 A * 2/1969 Boucher et al. ..... 220/565
(Continued)

FOREIGN PATENT DOCUMENTS

AU 40031/78 A1 3/1980
DE 2029748 A 4/1971
(Continued)

*Primary Examiner* — Andrew Perreault
(74) *Attorney, Agent, or Firm* — Galvin Patent Law LLC; Brian R. Galvin

(57) ABSTRACT

The present invention relates to a transport container which provides mechanical and thermal stability for a load and which container is fabricated as the container is loaded. In particular, the present invention relates to a container which can be readily transported on aircraft, such as an aircraft container. In the field of logistics, that is the field of movement and supply of produce and materials, in particular in the transport of intermediate and finished products, containers have been developed which safely protect from physical damage a wide variety of product. Food and pharmaceutical products not only need protection from physical shock and pressures but also require temperature stability during transportation; otherwise goods can be damaged and be unusable, whether such damage is apparent or not. However, air transport poses a particular problem: Goods can be transported in tropical heat, packaged and placed upon pallets and the like containers whereby they are presented in aircraft style containers. Such goods may be left on runways at extreme temperatures (+40° C.) and then placed within a hold where low pressures and low temperatures exist during flight. At a destination airport the temperatures may well be sub-zero. To simplify transport with respect to airports, planes and handling equipment, there have been developed aircraft Unit Load Devices (ULDs) which comprise any type of pallet or container that can easily be loaded to the aircraft by a ground handler. The present invention seeks to provide a transport container which can maintain goods within a narrow temperature range, can displace a considerably reduced volume before erection, is economical to manufacture, can readily and easily be constructed. The present invention further seeks to provide a transport container which is compatible with standard Unit Load Device specifications.

11 Claims, 11 Drawing Sheets

(51) Int. Cl.

| | |
|---|---|
| ***B65D 25/54*** | (2006.01) |
| ***B23P 11/00*** | (2006.01) |
| ***B65D 88/14*** | (2006.01) |
| ***B65D 88/52*** | (2006.01) |
| ***B65D 90/00*** | (2006.01) |
| ***B65D 90/02*** | (2006.01) |
| ***B65D 90/06*** | (2006.01) |
| ***B65D 90/08*** | (2006.01) |
| ***F25D 3/06*** | (2006.01) |

(52) U.S. Cl.
CPC ..... *B65D 88/528* (2013.01); *B65D 90/00* (2013.01); *B65D 90/023* (2013.01); *B65D 90/06* (2013.01); *B65D 90/08* (2013.01); *F25D 3/06* (2013.01); *F25D 2303/08221* (2013.01); *F25D 2500/02* (2013.01); *Y10T 29/49826* (2015.01)

(58) Field of Classification Search
CPC .. B65D 88/528; B65D 88/14; B65D 88/3834; B65D 81/3827; B65D 90/00; B65D 90/023; B65D 90/08; B65D 90/06; F25D 3/06
See application file for complete search history.

(56) References Cited

U.S. PATENT DOCUMENTS

| | | | | |
|---|---|---|---|---|
| 3,955,700 | A | 5/1976 | Pedraza | |
| 4,266,670 | A | 5/1981 | Mykleby | |
| 4,531,278 | A | 7/1985 | Boykin | |
| 4,738,371 | A * | 4/1988 | Wakeman | 220/4.28 |
| 5,558,241 | A * | 9/1996 | Huffstutler et al. | 220/1.5 |
| 5,570,588 | A | 11/1996 | Lowe | |
| 6,041,958 | A * | 3/2000 | Tremelo | 220/4.28 |
| 2009/0032530 | A1 * | 2/2009 | Chu | 220/4.28 |

FOREIGN PATENT DOCUMENTS

| | | | |
|---|---|---|---|
| DE | 10225281 | C1 | 11/2003 |
| DE | 202005018423 | U1 | 4/2006 |
| EP | 1025405 | B1 | 7/2002 |
| FR | 2521689 | A | 8/1983 |
| GB | 1228572 | A | 4/1971 |
| GB | 13382230 | | 4/1973 |
| GB | 1382230 | A | 1/1975 |
| GB | 2013625 | A | 8/1979 |
| WO | WO-9922190 | | 5/1999 |
| WO | WO-2007/034901 | A1 | 9/2006 |

* cited by examiner

TRANSPORT CONTAINER

FIELD OF INVENTION

The present invention relates to a transport container which provides mechanical and thermal stability for a load and which container is fabricated as the container is loaded. In particular, the present invention relates to a container which can be readily transported on aircraft, such as an aircraft container.

BACKGROUND TO THE INVENTION

In the field of logistics, that is the field of movement and supply of produce and materials, in particular in the transport of intermediate and finished products, containers have been developed which safely protect from physical damage a wide variety of product. Food and pharmaceutical products not only need protection from physical shock and pressures but also require temperature stability during transportation; otherwise goods can be damaged and be unusable, whether such damage is apparent or not.

For example, in the pharmaceutical industry, product often needs to be maintained within a temperature range: product may be packed in relatively small containers, which containers are relatively fragile—accordingly insulation must provide both physical and thermal stability. Equally, in the food industry, fish suppliers will often have chilled fish boxes which are designed to accept, say 20 Kg of product. The fish must be maintained at low temperatures, yet will be placed in containers which require a high degree of strength to prevent spillage.

As the standards of living increases, in developed markets, for example in Europe and North America, tropical foods—that is foods grown in far-away tropical places—are increasingly being stocked by supermarkets, delicatessens and the like. Short pick to distribution centre times in the producing country are matched by air carriers taking goods to the countries of consumption in similar lengths of time, whereby it is not uncommon for fruit to be on the plates of householders within two to three days of having been picked in a far-away country.

However, air transport poses a particular problem: Goods can be transported in tropical heat, packaged and placed upon pallets and the like containers whereby they are presented in aircraft style containers. Such goods may be left on runways at extreme temperatures (+40° C.) and then placed within a hold where low pressures and low temperatures exist during flight. At a destination airport the temperatures may well be sub-zero. A corollary to this is the production of temperature sensitive pharmaceuticals in a "developed" country which pharmaceuticals must be transported to another side of the world with similar temperature variations.

Both the above scenarios place transport managers in difficult positions. For air haulage, containers should weigh little, make use of non-rectangular hold spaces within aircraft; for the goods, they must be protected from shock, be maintained within a narrow temperature range, sometimes being equipped with temperature data loggers whereby a record of temperature within a container may determine whether or not a pharmaceutical is destroyed prior to use because of poor temperature handling. Refrigeration units may be provided with a container whereby temperatures maybe maintained, but then a source of electrical power or fuel for a powered generator is required.

To simplify transport with respect to airports, planes and handling equipment, there have been developed aircraft Unit Load Devices (ULDs) which comprise any type of pallet or container that can easily be loaded to the aircraft by a ground handler. Aircraft ULDs are units which interface directly with an aircraft loading and restraint system, without the use of supplementary equipment. There are pre-defined ULDs, such as LD3, LD7, which correspond to standard configurations and can be utilised on certain types of aircraft. There are still further ULDs that are shaped such that they have a rectangular base yet are not generally cylindrical, that is to say they extend outwardly, beyond the sides of the base, as they extend upwardly from the base. There is also an increasing demand for many containers, especially aircraft ULDs that they are transported from a supplier in a flat-pack fashion and they are constructed prior to use. This enables warehousing requirements to be reduced by typically 66-75%.

EP1025405 provides a container which has its cavity bounded by boundary elements, comprising a roof element, floor element, side walls and an end element. The boundary elements contain wall cores of hard foam plastics such as polyurethane. The rail core is edged with edging beams of fibre-reinforced plastics. The boundary elements are fixed rigidly to each other on connecting surfaces in the region of the edge beams. Standard doors can be used. Glass-fibre-reinforced plastics panels are combined with steel components to provide an assembly which whilst strong is not capable of being dismantled.

U.S. Pat. No. 4,266,670 provides a collapsible, reinforced, four sided container attached to a rigid base, of the type for transporting heavy products, such as iron. This design is collapsible whereby on a return journey it may be shipped in reduced size for reuse. This container is manufactured from reinforced corrugated cardboard. An example of this teaching is shown in FIG. 1, which container 10 comprises a pallet base 40, upon which are placed side panels 10-13. Each of the side panels have complementary edges having mortise and tenon elements, with an aperture running through, whereby stakes 107-110 may be inserted to enable the sides to remain upright. The panels provide a limited amount of temperature insulation, especially taking into account the relatively large size of the cardboard panels, being approximately 15 cm thick. One side may be easily opened for loading or unloading.

U.S. Pat. No. 2,556,418 provides a thermally insulated container and pallet. Telescopic tubes are mounted upon each of the four corners of a pallet to provide an enclosure frame which is built up with canvas straps and subsequently insulated. Refrigerant gasses may be introduced into the enclosure once a canvas wrap is positioned around the container.

GB1382230 provides a heat-insulating protective cover for temperature-sensitive goods comprises a carrier frame adapted to be positioned over the top surface of the goods, which rest on a pallet, and provided with support legs for this purpose. Walls of flexible heat-insulating material extend around the carrier frame and can be lowered from a retracted position to a lowered position, the walls being connected at their upper edges to a layer of heat-insulating material. Lift ropes are attached to the lower edges of the walls and extend up through eyelets to a common pull rope so as to permit the simultaneous lifting of all the walls to an upper position adjacent the carrier frame. The lower edges of the walls are provided with rings adapted to be hooked on to co-operating hooks on the pallet to provide a heat insulating space between the pallet and the carrier frame.

U.S. Pat. No. 3,955,700 teaches of an aircraft container which has a moulded reinforced fibreglass enclosure, which has two removable panels on one side which provide access to the interior. Whilst this solution provides a strong and rigid—yet resilient—container, when empty the container takes as much space as when full, which is not acceptable for many supply industries. Furthermore, by providing an enclosure, limitations are placed with respect to the order of packing and the addition of goods to be despatched, which can provide complications and expense to any freight manager.

It is notable that there are few thermally insulating cargo containers; either they are rigid yet not collapsible or are collapsible yet easily damaged when shifted by fork-lifts and other and/or are complex to assemble.

OBJECT OF THE INVENTION

The present invention seeks to provide a solution to the problems addressed above. The present invention seeks to provide a transport container which can be manufactured at low cost and can readily and easily be constructed. The present invention seeks to provide a transport container which can be erected at point of use. Furthermore, the present invention seeks to provide a container that when completed can maintain goods within a narrow temperature range.

The present invention further seeks to provide a transport container which is compatible with standard Unit Load Device specifications.

STATEMENT OF INVENTION

In accordance with a general aspect of the invention, there is provided a thermally insulating collapsible transport container fabricated from at least one set of co-operating first and second panels arranged substantially at right angles to one another, the first and second panels having first (outside) and second (inside) major surfaces and a circumferential edge portion, wherein a first panel defines a rebated channel on an inside face of the panel, the channel being adjacent to at least one edge, the rebate being defined in cross-section by an edge face of the panel and a general L-shape, a first arm of the L-shape section defining, in use, part of the outside wall of the first member, the second arm of the L-shape section having an inside face opposing said edge face of the panel, whereby to define a rebate into which an edge portion of the second panel can be received and resiliently retained therein. By having separate panels resiliently retained, air passage between an inside and an outside of a container is prevented.

Conveniently, the container comprises at least a base and upstanding wall panels, wherein the base panel corresponds to the first panel type and the wall panels correspond to the second panel type. Conveniently, the panels are of rectangular shape in plan view. The container can have a variety of forms, but a rectangular box would be the most frequently employed, even though it would be possible to have square section or cylindrical section boxes; indeed, the walls could be non-vertical, at least in part. Preferably, the container further comprises one or more insulating cover panels, which insulating cover panels correspond in type with either the first or second panel type, whereby the cover panel can be resiliently retained with respect to an upstanding wall panel. By having separate panels resiliently retained, air passage between an inside and an outside of a container is prevented.

The insulating panels can be fabricated from one or more types of panel including extruded polystyrene, polyurethane foam, expanded polystyrene, cardboard, laminated polyurethane foam, laminated expanded polystyrene, or moulded plastics. The laminate face can comprise one of card, plywood, polypropylene, aluminium or steel. The L-section of the panel may be formed as an integral part of the panel when, for example it is moulded, part of a reinforced plastics (resin) moulding or, formed by the addition of an "L" section member to an insulating panel, for example, an inside face of an "L" section member is attached by adhesive (for example) to an outside edge of the insulating panel, a second inside edge of the "L" section member facing an edge portion, rebated or otherwise, of the insulating panel member. The separate L-shape members can conveniently be made from one of wood pulp, polypropylene, aluminium, glass fibre, resin, carbon fibre. The edge portion of the first panel can be stepped, wherein, in use, the edge portion of the second panel abuts against a portion of the step.

In use, the base member may be positioned upon a pallet and subsequently placed upon an aircraft container base. In the alternative, feet depend from the base so as to dispense with a pallet, which is beneficial in certain loading environments, where natural products such as wood pallets are not welcome in view of the possible contamination in clean-area loading bays.

Conveniently, a weatherproof sheet is arranged about the assembled container in use. Preferably, the weatherproof sheet provides a thermal barrier. Conveniently the weatherproof sheet is retained by a cargo net, which attaches within a recess of a pallet base to provide an integrated weatherproof container system. A thermal sheet can surround the panels and can be retained by a cargo net. Conveniently, the cargo net comprises any one or more of webbing or elasticated cords. Conveniently, the net has feet which locate into channels defined along peripheral edges of the base or into an aircraft unit load base formed with sheet aluminium, aluminium alloy or alternative material.

In accordance with another aspect of the invention, there is provided a method of fabricating a transport container, wherein the container comprises at least one set of co-operating first and second panels arranged substantially at right angles to one another, the first and second panels having first outside and second inside major surfaces and a circumferential edge portion, wherein a first panel having a general L-shape cross-section element defines a rebate along an edge portion and is operable to accept an edge portion of the second panel, a first arm of the L-shape section comprising part of the outside wall of the first member, the second arm of the L-shape section opposing an edge face of the first pane, wherein the method includes the step of introducing an edge portion of a second panel into the rebate, urging an outer face of the second panel against an inside face of the upstanding arm of the L-shape member, until the edge of the second panel abuts an inside rebate surface, whereby first and second panels can be resiliently retained, one with respect to another. By repeating the steps with respect to associated adjacent edges, a container can be simply formed.

Conveniently, the container comprises base elements and wall panels wherein the base and wall panels cooperate with respect to each other as first and second panels. The first and second wall elements about a corner section can cooperate with respect to each other as first and second panels. Preferably, the container further includes top panels, wherein the container comprises top and wall panels cooperate with respect to each other as first and second panels.

The base, sidewall and top members are conveniently flat panels, made of extruded polystyrene, expanded polyurethane or polyethylene foam. Conveniently, the foam panels are laminated whereby to provide optimum rigidity, with a light weight, with good thermal barrier properties. Ideally, the edges of any adjoining co-planar panel members have complimentary rebates. An advantage arising from the use of materials such as polyethylene foam means that thermal insulation and physical shock protection is extremely high with regard to known container systems. The L-section member can be integrally moulded, using a glass reinforced plastics material exterior laminate, which is secured to plastics foam elements, for insulation.

In accordance with a still further aspect of the invention, there is provided a container having on an inside surface of a wall an envelope for supporting a temperature control pack, the envelope comprising an aperture having a width and a depth to accommodate one or more temperature control packs, the temperature control pack being spaced from a product within the container by a spacer element.

BRIEF DESCRIPTION OF THE FIGURES

For a better understanding of the present invention, reference will now be made, by way of example only, to the Figures as shown in the accompanying drawing sheets, wherein:—

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Figure 1:
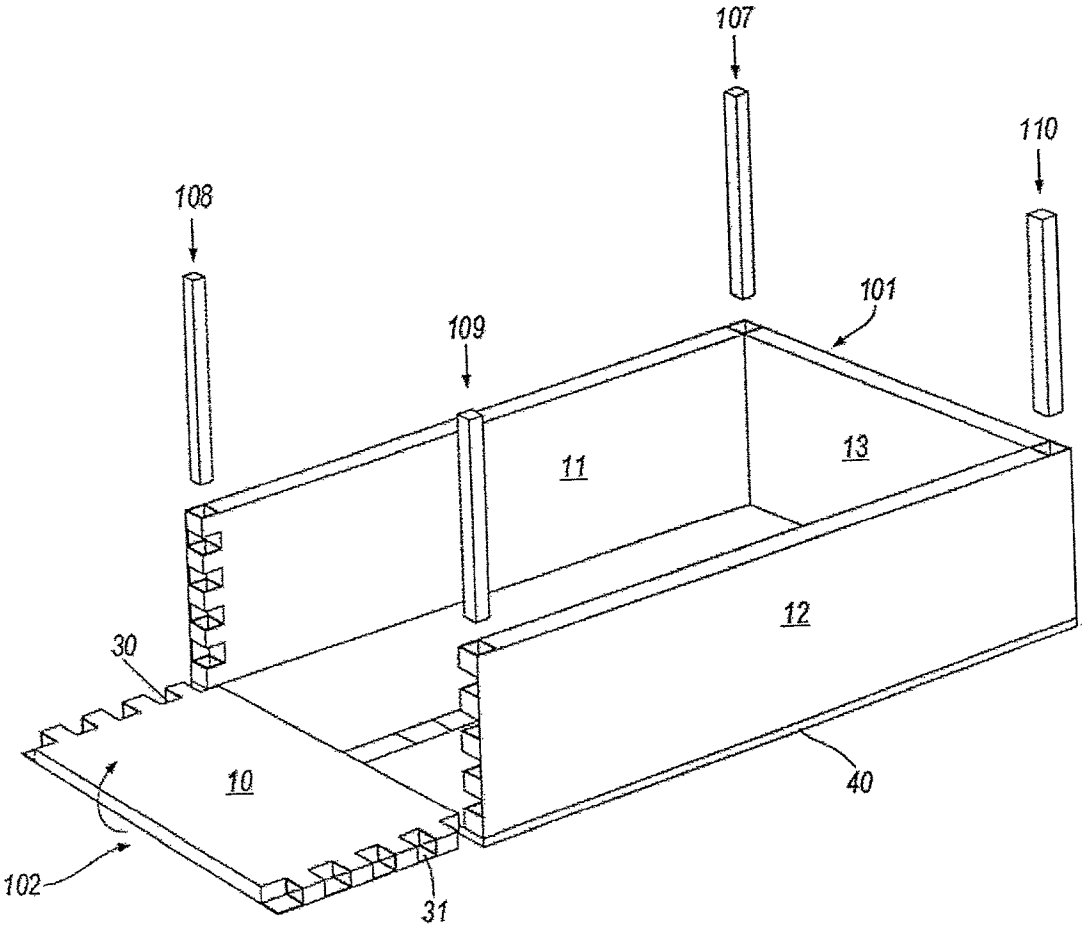
Fig. 1 PRIOR ART
FIG. 1 illustrates a prior-art transport container.
Figure 2A:
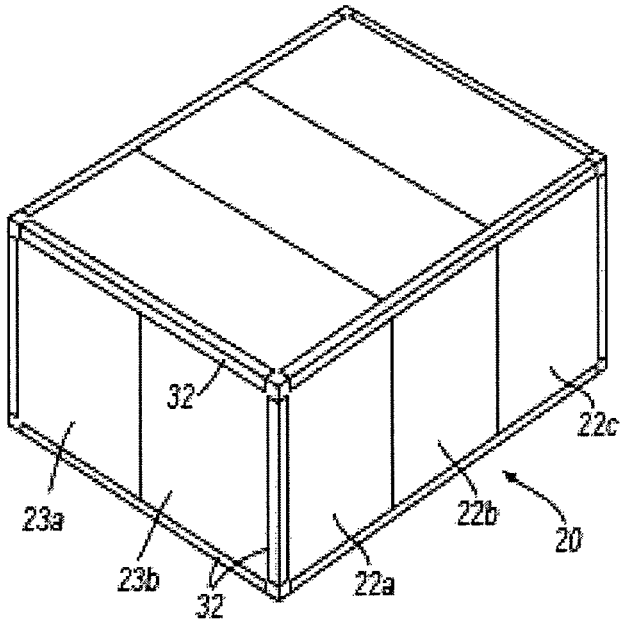
FIGS. 2*a* & 2*b* illustrate a first embodiment of the invention in assembled form, upon an air pallet and with weatherproofing in place.

FIG. 2 shows a first embodiment 20 of the invention in an assembled state. Whilst a base panel is not shown in any detail, outwardly extending the L-section corner sections (to be referred to as L-members hereinafter) 32 depending from the base panel are shown. These L-members are derived from corner guards as used in the packaging industry, (where they are also referred to as V-boards) which are typically retained in place with plastics wrapping film and or polystyrene mouldings about a package.

Figure 2B:
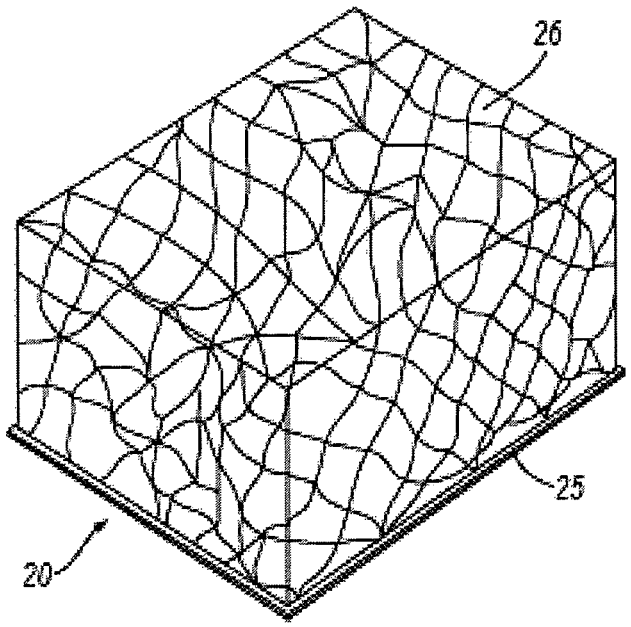

The top panels, in this embodiment correspond from an outward perspective, to the base panel, each comprise three panels, which are made from an insulating material such as extruded polystyrene, polyurethane, expanded polystyrene or may comprise a composite panel, as will be discussed below. Similarly, the long sides of the container comprise three panels, 23*a*, 23*b*, 23*c*. The outer edges of the panels 23 *a* and 23 *c* each have an L-member 32 attached thereto. The short sides of the container comprise two panels 23*a*, 23*b*. Conveniently, either the outer panels of the long side, 22*a*, 22*c* have an L-member as shown, or the panels 23*a*, 23*b* have an L-member. When used with an air pallet, to comprise a ULD shipment, the container in accordance with the invention will be placed upon such an air pallet 25 and a cargo net 26 will be strapped around the container as shown in FIG. 2*b*. Whilst the insulating panels closely fit together to prevent gaseous exchange—and this heat transfer—it is common for thermally insulating outer bags to be employed in the transport of temperature sensitive produce and such a bag could be placed around the container and be secured by the cargo net 26. The cargo net will have ground anchor devices which locate into an air cargo pallet as will be detailed later.

Figure 3A:
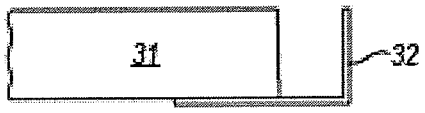
FIG. 3*a* details a base member in accordance with the invention.
Figure 3B:
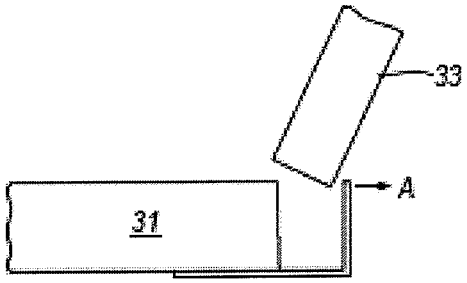
FIG. 3*b* details a base member per FIG. 3*a* with a side member partly inserted.
Figure 3C:
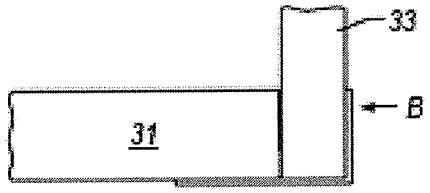
FIG. 3*c* details a base member per FIG. 3*a* with a side member fully inserted.
Figure 3D:
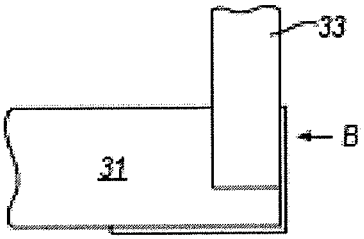
FIG. 3*d* details an alternative arrangement.

FIG. 3*a* shows part of a base member 31. Conveniently, the material would comprise extruded polystyrene or polyurethane foam and have a thickness of approximately 50-80 mm. Reference numeral 32 refers to an L-member in accordance with the invention, the member being rigid and is fabricated from a number of possible materials, such as wood-pulp, aluminium, steel, polypropylene, glass fibre, carbon fibre, for example. The thickness of the L-member is dependent upon the material form which it is manufactured, but for wood-pulp, a thickness of 4-6 mm is typical. Importantly, this will not have any appreciable affect upon the manner of the base sitting upon a pallet etc., for example. The exact dimension of the L-member will vary upon application, but for the example shown, the horizontal arm is 90 mm and the vertical arm, at 50 mm corresponds with the height of the insulating base material—primarily since the container will be loaded prior to erection of the sided walls and therefore the vertical arm should not extend above the height of the insulating material since it would otherwise be susceptible of being damaged by the forks of a forklift truck as the load is placed upon the base. If the load were to be lifted by crane, for example, then the height of the vertical arm would not be so critical. It has been found that the L-member can be attached to the insulating panel by a double-sided tape, such as Thorn-Carless product 95623-M, which is a solvent-free modified acrylic adhesive and has a thickness of approximately 0.23 mm. In FIG. 3*b*, there is shown a lower edge of a side panel 33 being inserted between the L-member and the insulating material of the base, the upstanding arm of the L-member being urged outwardly in the direction shown by arrow A, to enable insertion of the panel 33. Conveniently, the internal angle of the L-member is less than 90°, for example in the range of 82°-88°, whereby the side member is resiliently retained within the rebate defined by the base insulating member and the L-member, as shown in FIG. 3*c*, the upstanding leg of the L-member acting towards the upstanding panel in the direction shown by arrow B. To attach the L-member by, for example, screws could compromise the thermal insulation properties of the insulating material, but may be preferred in certain circumstances. FIG. 3*d* shows an alternative, wherein the base member comprises a stepped rebate; other variations are also possible. Notwithstanding the above, the side members may be introduced into the channel or rebate defined between the L-member and the base (or other co-operating wall—wall or wall-top sections) such that the tongue of the introduced panel member is resiliently squeezed, without causing the L member to be urged outwardly or to be urged outwardly relatively insignificantly. The portion of the tongue of the panel that is introduced into the rebate may be coated with a plastics coating such as a Teflon® spray, which increases the durability of the tongue, in the event that repeated use of the same panel occurs.

It will be appreciated that variations of the insulating base and L-member are possible. For example, the base material may comprise a rebated portion and the L-section arm is coplanar with the outside face of the panel. By the provision of such an arrangement, goods can be placed upon a base prior to erection of walls of the container, with a subsequent erection of the walls by the simple act of inserting them within a channel defined in part by the L-members, without fear of the wall collapsing. This has been found to enable a rapid loading of air-cargo pallets, for example. It will be appreciated that a rapid transfer of product shortens the time that product will not be in a temperature-controlled environment. In a most simple embodiment of the invention, only the base insulating member L-members extending from the outside edges thereof. Notwithstanding this, it is preferred that at least the top portions of the container have panels with the L-members extending from outer edges, whereby to enable the goods to be covered in an equally simple fashion. In the alternative, straps could be placed around the top of the container and around the sides, but many of the advantages of the speed of erecting the containers will be lost. Equally, the corner elements of the sidewall should similarly be protected.

Figure 4:
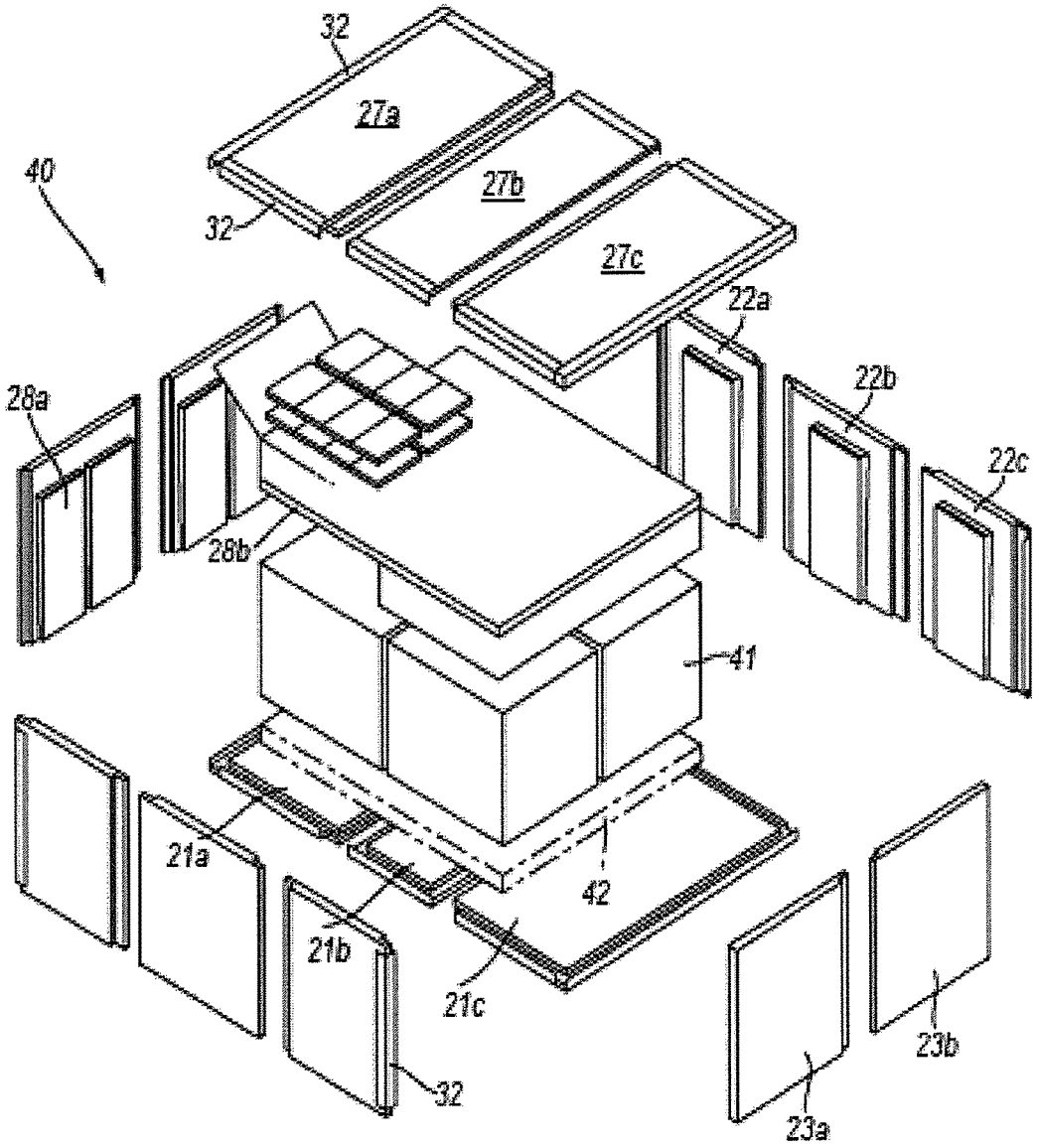
FIGS. 4, 5*a* & 5*b* show exploded views of the first, second and third embodiments.

FIG. 4 shows in some detail how a container in accordance with the invention can be utilised. Container 40 includes four load boxes 41 mounted upon pallets 42, which are, in turn placed upon base members 22*a*, 22*b* and 22*c*, as described above, with trim members 32 around the peripheral edges. The long-side panels 23*a*-23*c* have interlocking features between themselves, conveniently by way of corresponding rebates, whereby to minimise the presence of any gaps therebetween. Panels 23*a* and 23*c* have vertical L-members 32; similarly the short-side panels 24*a*, 24*b* interlock with each other and with adjacent panels of the long-sides, the L-member ensuring that there are no gaps between the corners edges between adjacent side wall panels. The upper insulating panels 27*a*, 27*b* and 27*c*, as mentioned above are generally similar to the base panels and engage with the upper edges of the side-wall panels, the L-members assisting in maintenance of gap-free edges between the side panels. It will be appreciated that the tongues of a first panel tightly fitting within the rebate defined between an inside wall of a the L-member on one side of the tongue and between an edge portion of the panel on the other side of the tongue FIG. 4 also shows cardboard envelopes 28*a* and boxes 28*b* which can retain gel packs, for example, which have a high heat capacity whereby to assist in the maintenance of a particular temperature. The load is contained in boxes 41, mounted upon pallets 42. The base, side and top panels may all be manufactured from plastics foam sheets, such as extruded polystyrene or polyurethane. However, in certain circumstances, the panels may comprise expanded polystyrene sheathed with, for example, cardboard, polypropylene sheeting or other types of sheathing. In use, the containers can be disposed of after their first use, due in part to the one-way nature of the cargo involved, be it agricultural produce, say from farms in Africa to Europe or the delivery of pharmaceutical goods. The invention provides a simple to fabricate container which can retain goods reliably within a specific temperature range, achieved, in part, through the use of suitable gel packs filled with substances with a high thermal capacity, together with the inherently low thermal conductivity of the container and the relative air-tightness of the joins between the panels.

Figure 5A:
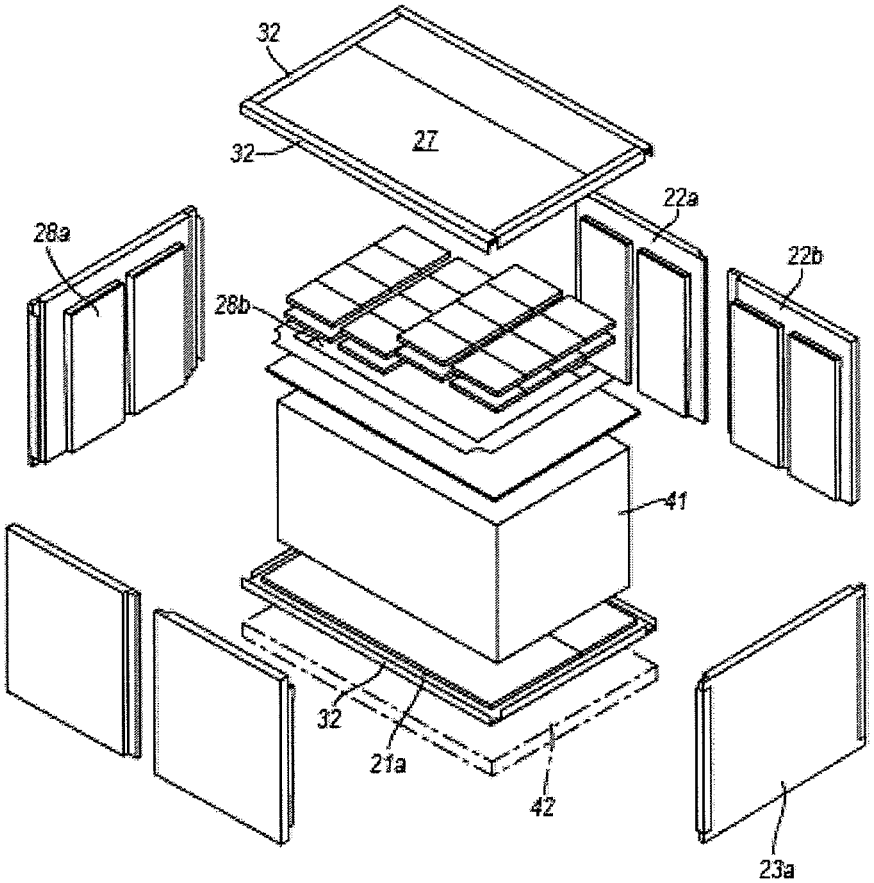
Figure 5B:
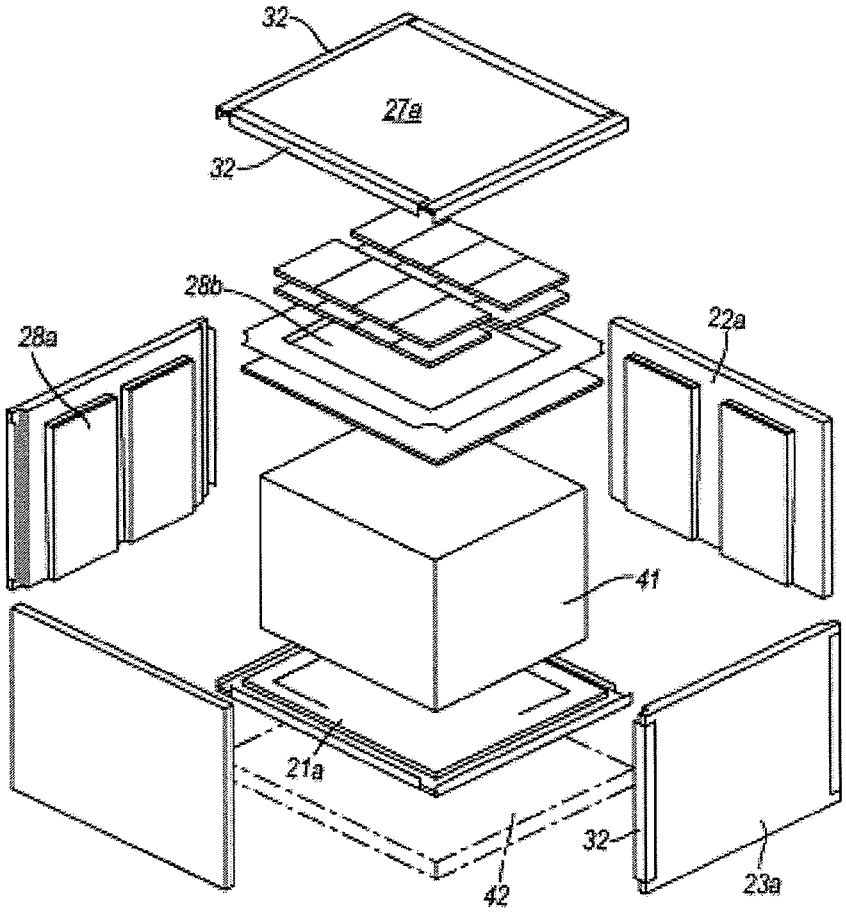

FIG. 5*a* refers to a first variant in that the container is a half LD7 load; there is a single base panel 21*a* and top panel 27*a*, with L-members 32 attached to peripheral edges. There are two side panels 22*a*, 22*b* along the long side; the shorter side panels comprise a single element 23*a* which possesses L-members 32 along both vertically oriented edges. The bas panel of the container sits upon a pallet 42. FIG. 5*b* shows a still further embodiment: this container varies form the embodiment of FIG. 5*a* in that the external dimensions are different and that each of the four sides comprise a single side panel.

The foam panels are conveniently of a laminated construction, whereby, using different densities of foam a lightweight yet stiff structure can be provided. Conveniently these can be provided by commercially available HCFC-free expanded Polyethylene sheet (LDPE), where there is a closed cell structure with extrusion skin. This provides a low water absorption and water-vapour transmission rate. The foam has a high resiliency and flexibility, excellent cushioning behaviour and excellent thermal insulation properties, with a temperature stability of −40 to +70° C. Commercially available foams of such construction are manufactured by companies such as Knauf Insulation Ltd., Sealed Air Inc. etc. It has also been found that when laminated panels of differing density are employed, there is a reduced tendency of the product panels to bow. Through an appropriate choice of materials, lightweight panels can be selected to provide a resilient container which can elastically deform and return to an original position, albeit in a limited fashion.

Figure 5C:
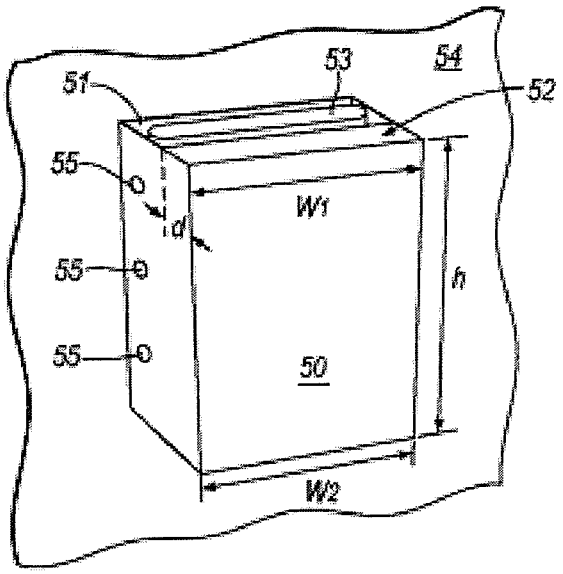
FIG. 5*c-e* shows a first, second and third thermal mass envelopes or sleeves.
Figure 5D:
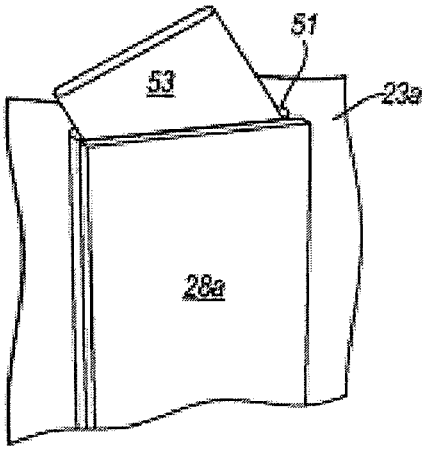
Figure 5E:
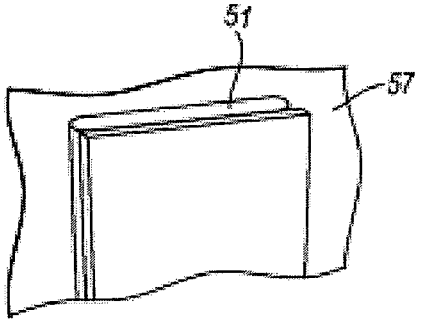

Referring now to FIG. 5*c*, there is shown a more detailed view of envelope 28*a*, which is attached to an inside face of a side panel. It is typical for refrigerant packs or gel packs (and other types of materials) to be employed as a refrigerant, to maintain a product within a specified temperature range, to maintain a thermal environment in an insulated shipping container sufficient to meet the product's temperature requirements. A few thermodynamic concepts are involved here: heat transfer, heat absorption, and phase change. These principles are some of the components of the "zeroth law" of thermodynamics. That is, all systems attempt to reach a state in which heat energy is equally distributed. If an object with a higher temperature comes in contact with a lower-temperature object, it will transfer heat to the lower-temperature object. It is to be noted that certain goods must be maintained below ambient temperature; others at above ambient temperature and some at elevated temperature. Such packs have been placed loosely in the container, sometimes within boxes. However, disadvantages arise in that the packs may congregate in a specific area(s), providing an uneven temperature distribution within a container, perhaps damaging product which comes into contact with the gel-packs; the gel-packs or similar may become damaged and rupture, potentially spoiling the contents of a container. The refrigerant envelope can comprise in a simple embodiment a cardboard enclosure, having a rear wall which is attached to a wall of a container, for example by double sided tape—conveniently the same type of tape as employed in the attachment of the L-shaped members. Two open—ended enclosures are defined by the envelope. A first enclosure 51 is for placement of gel-packs 53 and similar objects with a high thermal capacity is located such that, in use, it lies adjacent a container wall 54; a second enclosure 52 provides a minimum distance between the gel-packs and the product. Apertures 55 can be provided in a wall of the first enclosure to enable the position of a gel pack within to be determined. Equally, such aperture may assist in allowing convection currents to flow The gel-packs comprise units of a solid, being of a generally rectangular shape; FIG. 5*d* shows how a gel pack 53 can be inserted into a first enclosure of an envelope or pocket 28*a* mounted upon a container wall panel 23*a*. Applicants have determined that by reducing the width of the enclosure 51 from the top w1 to a width w2, where w2 is less than (say 95%) the width of a gel pack w3, then the gel packs can be safely inserted into an enclosure without fear of the pack becoming dislodged as a panel is erected (it will be appreciated, since the height of a side panel of a unit load device is frequently of the order of 2 m or more, that the subsequent insertion of a gel pack is ill-advised, since the gel pack could be liable of not being placed properly within its designated place, if any). This could also be of advantage in use of the container, to prevent spillage. The envelope may be placed such that it has a gap between a floor of the container, whereby to assist in the use of convection currents to provide a uniform temperature within the atmosphere of the container. FIG. 5*e* shows a still further embodiment with an envelope 50 having a solid insulating foam material 57 between the gel pack 51 and product, which, when packaged, will be in close proximity to the envelope unit including spacer 52, 57. Whilst the dimensions of the gel pack can vary, a pack size that has been found to be of a convenient size and weight (3 Kg) is dimensioned 44.7 cm×28.6 cm×3.6 cm. The envelope is conveniently manufactured from corrugated cardboard. Three or more gel packs may be inserted within an envelope. Since it is a commonly used material in the packaging industry and the skills for fabricating and attaching the envelopes are well known. A length of tape may be attached to an upper section of an aperture, in the middle of a face of the aperture; by placing a lower side of a gel pack in contact with the tape, the pack may be lowered in a controlled fashion. A gel pack may have an indentation upon an edge to assist in this procedure, without fear of the gel pack slipping either side of the tape.

It has been found that using three panels for the top section for the LD7, then the size and weight of the panels is not too great to prevent easy handling of the panels by manual workers. This size of panel e.g. 2×3 m for an LD7 container can be utilised in corresponding pro-rata sizes for smaller Load Device models or, indeed, fewer panels can be employed—what is of particular note is that the modular design of panel size can be utilised for many variants of Load Device container styles.

Figure 6:
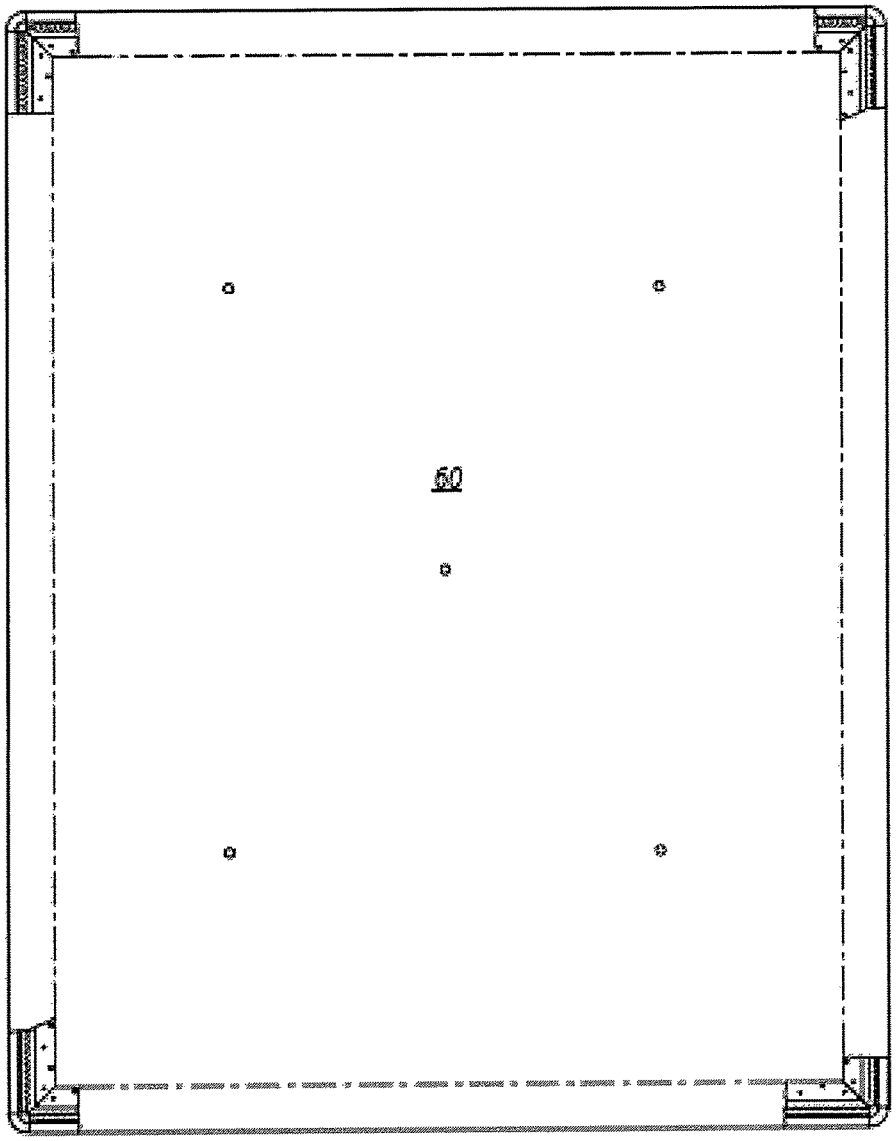
FIGS. 6, 6*a* & 6*b* shows a pallet base and details thereof.
Figure 6A:
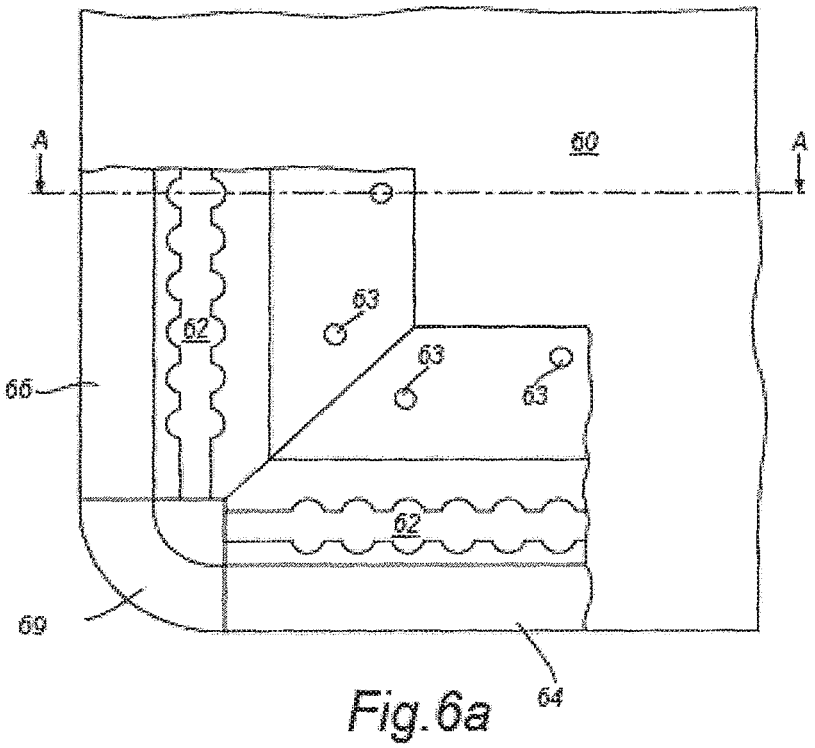
Figure 6B:
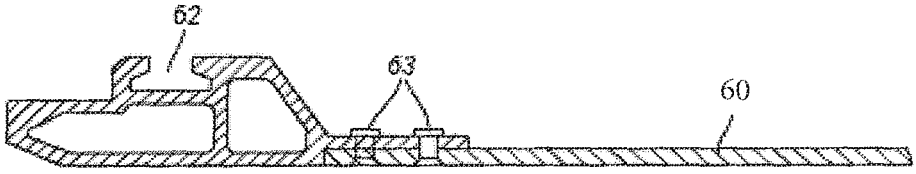
Figure 7:
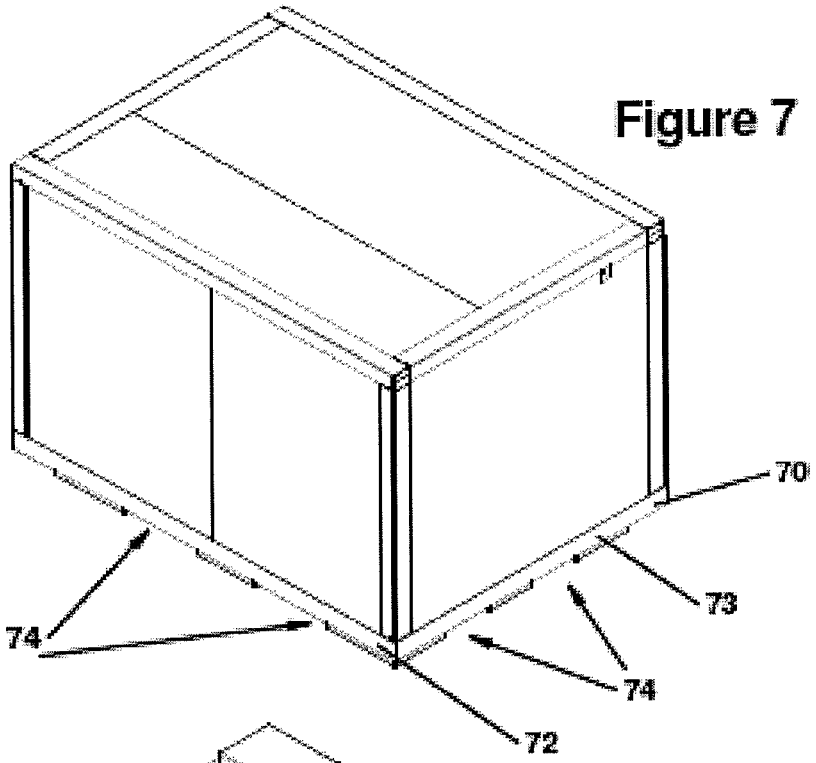
FIG. 7 shows a fourth embodiment.

FIG. 6 shows an air pallet 60 in plan view. The sizes of these air pallets vary from 1.5×2 m to 2.5 m×4 m. The pallet comprises of a rectangular base, conveniently made from an aluminium alloy. Perimeter extrusions 64, 66 are fitted along the major sides, with cast metal (alloy) or moulded plastics corner pieces assisting in maintenance of the integrity of the structure, the extrusions being screw-fastened or riveted to the base plate. FIG. 6*a* shows the extrusion in plan view; FIG. 6*b* shows a section through A-A per FIG. 6*a*. Base 60 is clearly visible, as are the fastening means 63. A corner element connects the two edge extrusion pieces. Both of the figures detail channel 62, which channel exists around the perimeter to provide locating means for retaining straps (cargo net) and/or for the thermal blanket or sheet. With reference to FIG. 6*a*, the channel 62 has sides which define parallel portions interspersed by short lengths of increased width, whereby feet of a cargo net having a width greater than the channel width of the parallel sections of the channel can be inserted within the channel.

By the use of foam panels of a low thermal conductivity, little, if any, additional amount of insulation needs to be provided by any boxes within the container: this, in turn, means that there is more effective load space. Equally, the container enables certain goods to be better protected by being individually placed within a container.

Figure 8:
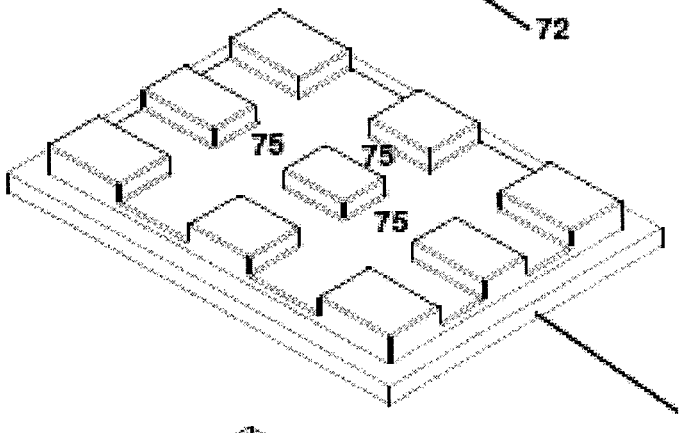
FIGS. 8 & 9 show view of the base in upturned and normal positions; and, FIGS. 10 & 11 show further views of the fourth embodiment.
Figure 11:
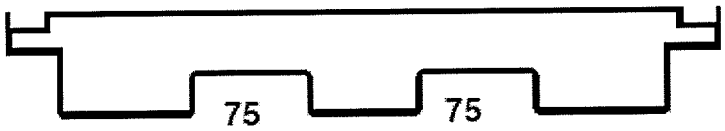

In accordance with a further aspect of the invention, and with reference to FIGS. 7-11, the base can integrally combine a pallet base. In the preferred embodiment, shown in perspective views from above, there is a completed container and a container base separated from an otherwise complete container. Two sides 72, 73 of the base element 70 are shown, each base element exposing apertures 74 being the openings to channels operable to accept the forks of a fork-lift truck (not shown), whereby to enable the container to be raised—or indeed, just the base be raised, prior to movement to a specific loading or unloading area. These channels 75 are best seen in FIG. 8, which shows the underside of a base in perspective view. Equally, FIG. 11 shows channels 75 defined by the cross-section of a shorter width of the base.

Figure 9:
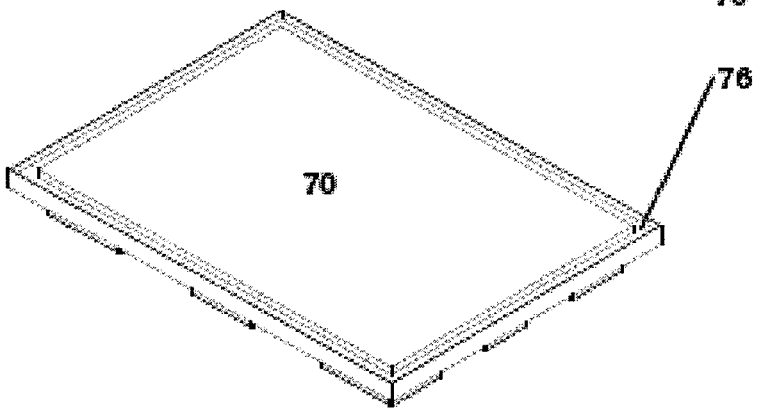
Figure 10:
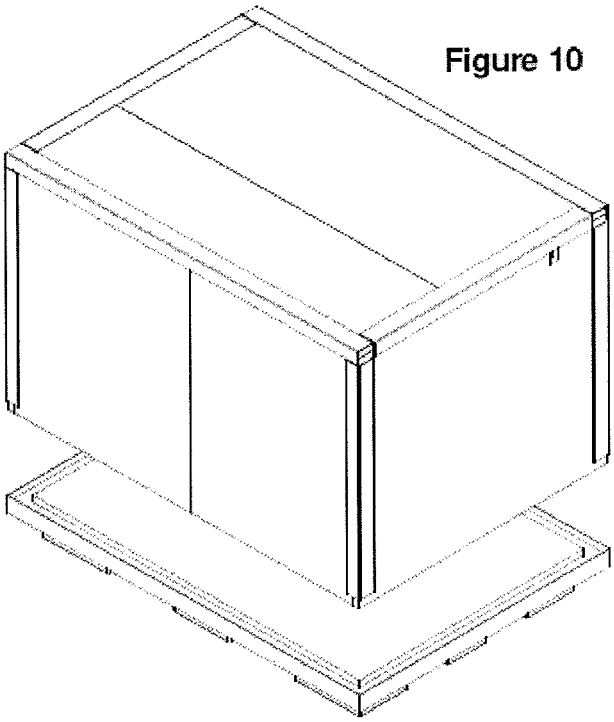

The base can be made such that a relatively rigid plastics material is utilized with a foam plastics, to provide a rigid body. FIG. 9 shows the base in an orientation of normal operation. The channel 76 comprising a rebate on the upper surface of the base 70 can be defined in such an outer plastics sheath member, such as glass reinforced plastics or similarly rigid material. Other foam plastics materials could also be employed; for example the base 70 may comprise a foamed plastics of uniform density, in which case separate "L" shape members will be attached and comprise a separate element, formed from mdf, or other appropriate materials, as described with reference to the first-third embodiments. By having the base constructed such that it dispenses with the need of a separate pallet, typically formed from wood, then this removes a problem that is apparent where certain industry sectors require transport containers and ancillary packaging materials to be free from organic products. This is a particular issue with certain pharmaceutical requirement for certain types of load, where integrated with a pallet base and manufactured from a plastics material.

In a still further variation, the base member may be fixedly associated with the aluminium sheet base 60 as shown in FIGS. 6-6*b*, whereby to enable the effective base area of the container, once constructed, to be increased, whereby to enable a greater volume per unit load device to be achieved.

The invention provides a simple to fabricate container which can retain goods reliably at a specified temperature due to the use of suitable agents, such as gel packs with high thermal capacities, together with the inherently low thermal conductivity of the container and good levels of sealing between panels. A container in accordance with the present invention may be assembled in a rapid and expeditious manner. The parts making up our box may be stacked for storage in a relatively small space. A distinct benefit of the present invention is that the construction permits different sized boxes to have common parts to provide more cost-effective construction and/or different functionality.

The invention claimed is:

1. A thermally insulating collapsible cargo container, the cargo container comprising:

a plurality of thermally insulating rectangular panels, each panel having a first and second, inner and outer major planar surfaces and four circumferential edges;

wherein a first panel and a second panel, each drawn from the plurality of thermally insulating rectangular panels, are physically arranged adjacent to each other along a mating edge comprising one of the circumferential edges of each of the panels;

wherein the first and second panels are interlocked along the mating edge, a major planar surface of the first panel being engaged perpendicularly with respect to a major planar surface of the second panel, along the mating edge;

wherein a mating edge portion of the first panel comprises one of the circumferential edges of the first panel, and defines a rebate in conjunction with a member of the second panel, forming an L-shape member whereby the first and second panels are interlocked, the L-shape member having a generally L-shaped cross section, a first arm of the L-shape member being attached to a major planar surface of the first panel, a second arm of the L-shape member opposing an edge face of the first panel;

wherein a mating interface edge portion of the second panel comprises at least a portion of a major planar surface of the second panel, and defines a rectilinear edge of the second panel such that each second panel mating interface edge portion is resiliently retained within the rebate of the associated first panel mating edge portion with the second arm of the L-shape member acting upon an outside surface of the second panel;

wherein resiliently retaining the second panel mating interface edge portion within the rebate of the associated first panel mating edge portion prevents air passage between an inside and an outside of the thermally insulated collapsible cargo container; and wherein an internal angle of the L-shape member is less than 90°, the second arm of the L-shape member acting upon a major planar surface of the second panel to resiliently retain the second panel without using a fastener to attach the second panel to the first panel; and wherein resiliently retaining the second panel of each of the plurality of pairs of panels render the container easily collapsible and reusable.

2. The cargo container according to claim 1, wherein the container comprises at least one panel that corresponds to a base and at least one panel that corresponds to an upstanding wall panel.

3. The cargo container according to claim 2, wherein the container further comprises one or more insulating cover panels.

4. The cargo container according to claim 3, wherein one or more cover panels can be resiliently retained with respect to the upstanding wall panel.

5. The cargo container according to claim 1, wherein the L-shape member is made from a material selected from the group comprising: wood pulp, polypropylene, aluminum, glass fiber, resin and carbon fiber.

6. The cargo container according to claim 1, wherein the L-shape member is attached by adhesive to the first panel.

7. The cargo container according to claim 1, wherein the thermally insulating panels are fabricated from one or more types of panel including extruded polystyrene, polyurethane foam, expanded polystyrene, cardboard, laminated polyurethane foam and laminated expanded polystyrene.

8. The cargo container according to claim 1, wherein the thermally insulating panels are laminated comprising an outer laminate and an inner laminate; wherein the outer laminate is selected from one or more materials of the group comprising: card, plywood, polypropylene, aluminum and steel.

9. The cargo container according to claim 1, wherein the mating edge portion of the first panel is stepped, wherein the mating edge portion of the second panel abuts against a portion of the step.

10. The cargo container according to claim 8, wherein the L-shape member is attached by adhesive to the thermally insulating panel.

11. The cargo container according to claim 1; wherein one or more of the plurality of thermally insulating panels of the container comprises two or more subpanels arranged coplanarly in a single spatial plane relative to one another forming a composite panel.

* * * * *